US009490085B1

(12) United States Patent
Flegel

(10) Patent No.: US 9,490,085 B1
(45) Date of Patent: Nov. 8, 2016

(54) 3-MOTION INTERLOCK FOR ALIGNED SWITCHES

(71) Applicant: Reliance Controls Corporation, Racine, WI (US)

(72) Inventor: David D. Flegel, Wind Point, WI (US)

(73) Assignee: Reliance Controls Corporation, Racine, WI (US)

( * ) Notice: Subject to any disclaimer, the term of this patent is extended or adjusted under 35 U.S.C. 154(b) by 0 days.

(21) Appl. No.: 14/734,487

(22) Filed: Jun. 9, 2015

Related U.S. Application Data

(60) Provisional application No. 62/009,563, filed on Jun. 9, 2014.

(51) Int. Cl.
*H01H 9/26* (2006.01)

(52) U.S. Cl.
CPC ..... *H01H 9/26* (2013.01); *H01H 2221/052* (2013.01)

(58) Field of Classification Search
CPC ..... H01H 9/20; H01H 9/26
USPC ..... 200/43.14, 50.32–50.33, 50.01–50.02, 200/50.04, 50.21, 50.35; 335/159–161
See application file for complete search history.

(56) References Cited

U.S. PATENT DOCUMENTS 3,239,988 A * 3/1966 Meyer ..... F16B 5/128 24/297
6,031,193 A 2/2000 Flegel
6,096,986 A 8/2000 Flegel
6,184,595 B1 2/2001 Flegel
6,521,849 B1 2/2003 Flegel
6,927,349 B1 8/2005 Flegel et al.
7,462,791 B1 12/2008 Flegel
7,531,762 B2 5/2009 Flegel
7,602,083 B1 10/2009 Flegel et al.
7,834,282 B2 11/2010 Flegel
8,110,759 B2 2/2012 Flegel
8,269,120 B1 9/2012 Flegel et al.
8,471,659 B1 6/2013 Flegel
8,723,361 B2 5/2014 Flegel
8,779,309 B2 7/2014 Flegel
2011/0100787 A1* 5/2011 Czarnecki ..... H01H 9/26 200/50.37

* cited by examiner

*Primary Examiner* — Renee Luebke
*Assistant Examiner* — Iman Malakooti
(74) *Attorney, Agent, or Firm* — Boyle & Fredrickson, S.C.

(57) ABSTRACT

An interlock arrangement is configured for controlling a pair of aligned switches connected to two alternate power supplies. An interlock member is positioned between the aligned switches and is moveable between a first interlock position and a second interlock position. The interlock member has first and second blocking components. In the first interlock position, the first switch is ON and the second blocking component prevents movement of the second switch to an ON position, and the interference between the first switch and first blocking component prevents the interlock member from moving to the second interlock position. In the second interlock position, the second switch is ON and the first blocking component prevents movement of the first switch to an ON position, and the interference between the second switch and second blocking component prevents the interlock member from moving to the first interlock position.

16 Claims, 6 Drawing Sheets

3-MOTION INTERLOCK FOR ALIGNED SWITCHES

CROSS-REFERENCE TO RELATED APPLICATIONS

This application claims priority to U.S. provisional application Ser. No. 62/009,563, filed Jun. 9, 2014, the entire contents of which is incorporated herein by reference.

BACKGROUND OF THE INVENTION

This invention relates to an interlock for controlling operation of a pair of switches, and more particularly to an interlock for controlling operation of a pair of aligned switches.

In many electrical installations, it may be desirable to provide simultaneous switching of electric switch handles, e.g., transfer switches. This may be found, for example, in an electrical distribution system that includes two power supplies, such as a primary power supply, such as utility power, and a backup power supply, such as an electrical generator. It is necessary to have a switching arrangement that controls the supply of power to the electrical distribution system. In one arrangement, each power supply is connected to a switch that is movable between an ON position that connects the power supply to the electrical distribution system and an OFF position that disconnects the power supply. The switches may be arranged in alignment with each other such that the switch handles are aligned. Provisions must be made to ensure that one power supply switch is in the OFF position when the other power supply is in the ON position and vice versa.

It is known to provide an interlock arrangement that functions to physically move one switch to the OFF position in response to movement of the other switch toward the ON position. Such mechanical interlocks are configured to make sure that each switch cannot be moved to its ON position before the other switch has been fully moved to its OFF position.

The present invention contemplates an interlock arrangement that introduces an additional step in the interlock process that requires an additional operation by a user before a switch can be placed in the ON position.

SUMMARY OF THE INVENTION

In accordance with a first aspect of the present invention, an interlock arrangement for a pair of aligned switches includes an interlock member that is positioned between the aligned switches and that is movable between a first interlock position and a second interlock position. The interlock member has a first blocking component and a second blocking component. When a first one of the switches is in the ON position in order to connect a first power supply, the interlock member is in a first interlock position in which the second blocking component prevents movement of the second switch toward the ON position. When the interlock member is in the first interlock position, the first blocking component is positioned such that, while the first switch is in the ON position, interference between the first blocking component and the first switch prevents movement of the interlock member away from the first interlock position.

When it is desired to switch power sources, the first switch is moved to the OFF position in order to disconnect the first power supply. When this occurs, the first switch is positioned so that it no longer interferes with movement of the first blocking component, and the user can move the interlock member from the first interlock position to the second interlock position. When the interlock member is moved to the second interlock position, the first blocking component is positioned so as to prevent movement of the first switch back to the ON position. The second blocking component of the interlock member is positioned so as to allow movement of the second switch from the OFF position to the ON position in order to connect the second power supply.

When the interlock member is in the second interlock position and the second switch is moved to the ON position, interference between the second blocking component and the second switch prevents movement of the interlock member away from the second interlock position, which insures that the first switch remains in the OFF position as long as the second switch is in the ON position. In order to reconnect the first power supply, the user must first move the second switch to the OFF position in order to disconnect the second power supply. The user can then return the interlock member to the first interlock position, which simultaneously prevents return movement of the second switch to the ON position due to interference with the second blocking component of the interlock member, and permits movement of the first switch to the ON position to reconnect the first power supply. Again, as long as the first switch remains in the first interlock position with the first switch in the ON position, the second switch cannot be moved to the ON position and the interlock member remains in the first interlock position due to interference between the first blocking component and the first switch.

Representatively, the interlock member may have a slot that extends transversely relative to the movement of the first and second switches. A pair of studs may be positioned within the slot to guide axial movement of the interlock member between the first and second interlock positions. An alignment bar may extend transversely with respect to the slot and is secured to the first and second switches. The slot may have a widened central portion within which the head of a screw is received. A base may be fitted between the first and second switches and supports the pair of studs. In the first interlock position, the second blocking component is in the line of movement of the second switch, and in the second interlock position, the first blocking component is in the line of movement of the first switch. When the interlock member is in the first interlock position, the first switch is blocked by the first blocking component such that a switch handle of the first switch contacts the first blocking component, and when the interlock member is in the second interlock position, the second switch is blocked by the second blocking component such that a switch handle of the second switch contacts the second blocking component. Representatively, the first and second blocking components may be upturned flanges.

In accordance with another aspect of the present invention, an interlock arrangement for aligned first and second switches includes an interlock member positioned between the first and second switches and movable between a first interlock position and a second interlock position. The interlock, member has a first blocking component and a second blocking component. When the first switch is in a first position, the interlock member is in the first interlock position in which the second blocking component prevents movement of the second switch toward its first position and the first blocking component is positioned such that, while the first switch is in the first position, interference between the first blocking component and the first switch prevents movement of the interlock member away from the first interlock position. When the second switch is in its first position, the interlock member is in the second interlock position in which the first blocking component prevents movement of the first switch toward its first position and the second blocking component is positioned such that, while the second switch is in the first position, interference between the second blocking component and the second switch prevents movement of the interlock member away from the second interlock position.

The invention also contemplates a method of operating an interlock arrangement for a pair of aligned switches, substantially in accordance with the foregoing summary.

Other aspects, features, and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which:

FIG. 6 is a top plan view similar to FIGS. 3 and 4, showing the interlock arrangement in a second position and in which the first switch is OFF and the second switch is ON.

Figure 1:
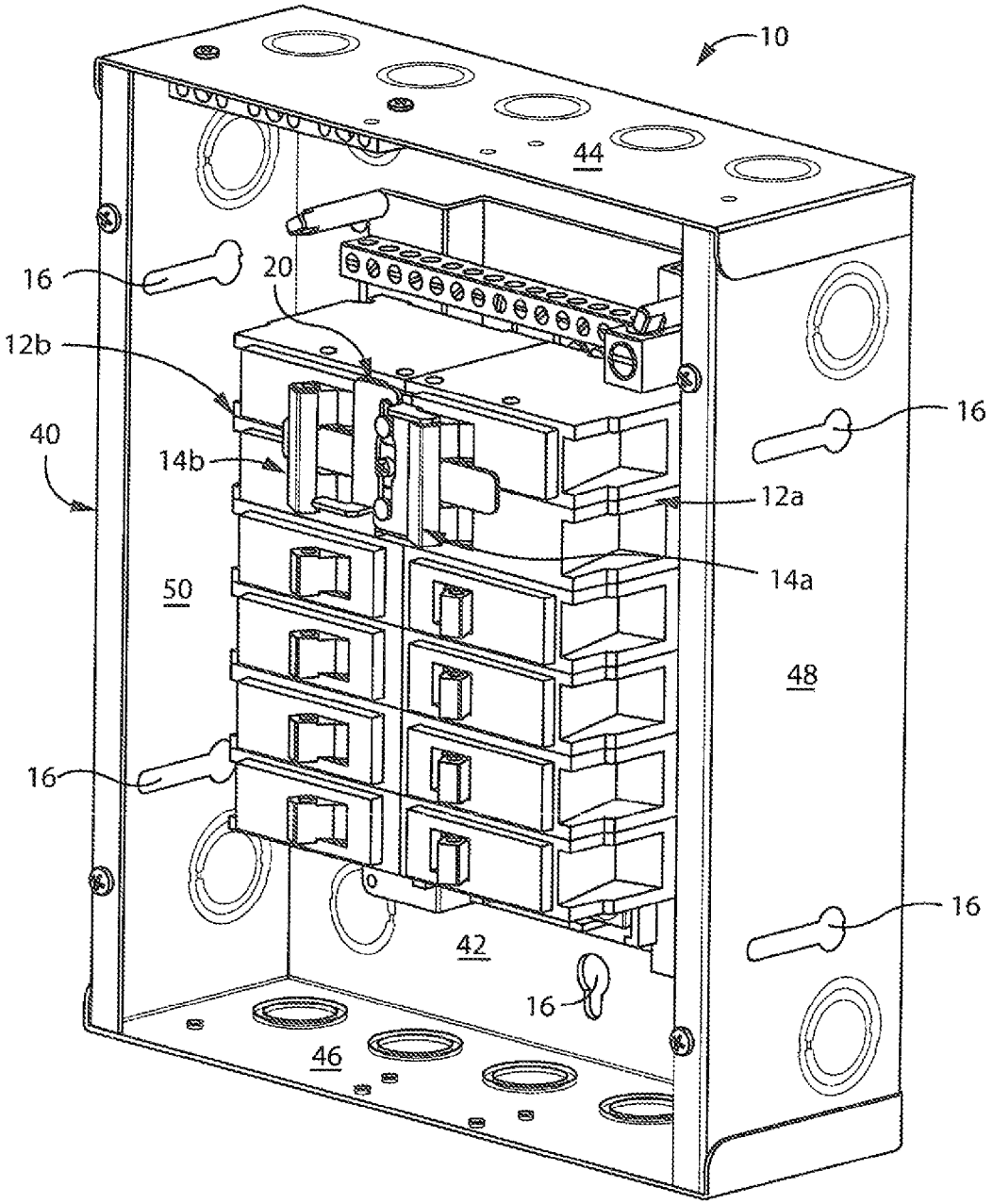
FIG. 1 is an isometric view of an interlock arrangement for controlling operation of a pair of switches, in accordance with the present invention, in association with a power transfer switch that includes a plurality of switches connecting a plurality of electrical circuits.

In describing the embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION

The various features and advantageous details of the subject matter disclosed herein are explained more fully with reference to the non-limiting embodiment described in detail in the following description.

This invention relates to a switch coupling assembly for coupling switch handles, and more particularly, pertains to a switch coupling assembly for electrical switches which couples a plurality of electrical switch handles with an additional manual step in the interlock process that requires an additional operation by a user before a switch can be placed in the ON position.

Referring to FIG. 1, a power transfer switch 10 according to one embodiment of the invention includes an interlock arrangement 20 coupled to a pair of switches 12*a*, 12*b* within a housing 40. The housing is defined by a back wall 42, a first or upper panel 44, a second or lower panel 46, a pair of sidewalls 48, 50 and a cover (not shown). The sidewalls 42, 44, 46, 48, 50 collectively define an interior volume of the housing 40. Apertures 16 may be formed in the housing walls, or tabs may extend from the housing, for mounting the power transfer switch 10 to a wall (not shown) or other mounting structure.

FIG. 1 shows the switches 12*a*, 12*b* in a representative installation, such as in the power transfer switch 10 or the like, which is used to connect a set of electrical circuits to one or the other of a pair of power supplies, such as utility power and backup generator power. It is understood, however, that interlock arrangement 20 may be used in any application in which it is desired to ensure that one switch is in an OFF position before another switch can be moved to an ON position.

The representative pair of switches, generally designated as 12*a* and 12*b*, may be used to selectively connect one of a pair of power supplies to an electrical load, such as the load center of the building. Representatively, one of the switches may be interconnected with a utility power supply and the other may be interconnected with an auxiliary power supply, such as an electrical generator. It is understood, however, that the switches 12*a*, 12*b* may be connected to any type of power supply and that the switches 12*a*, 12*b* are used to connect one or the other of the power supplies to the electrical load. In a manner as is known, switches 12*a*, 12*b* may be in the form of tandem breaker-type switches, the handles of which are tied together for movement in unison. For convenience, the tied-together switch handles of switch 12*a* are designated as switch handle 14*a* and the tied-together switch handles of switch 12*b* are designated as switch handle 14*b*. It is understood, however, that any type of switch mechanism or configuration may be employed.

Figure 2:
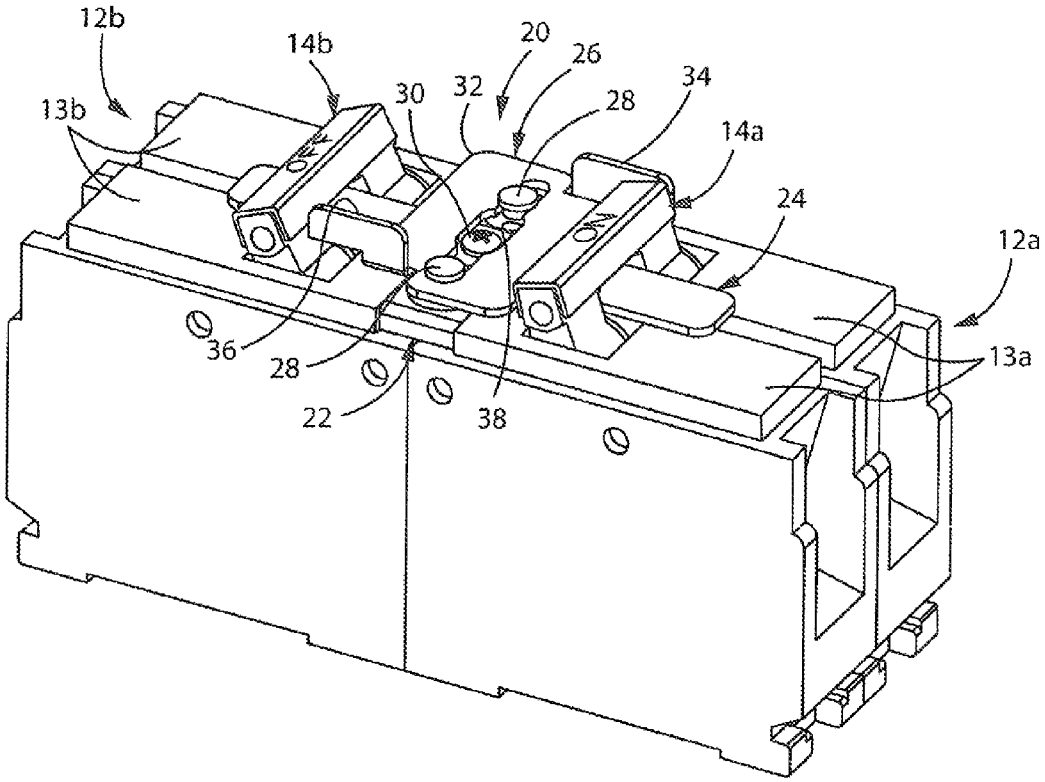
FIG. 2 is an isometric view of two aligned electrical switches removed from the power transfer switch of FIG. 1 and illustrating the interlock arrangement of the present invention.
Figure 3:
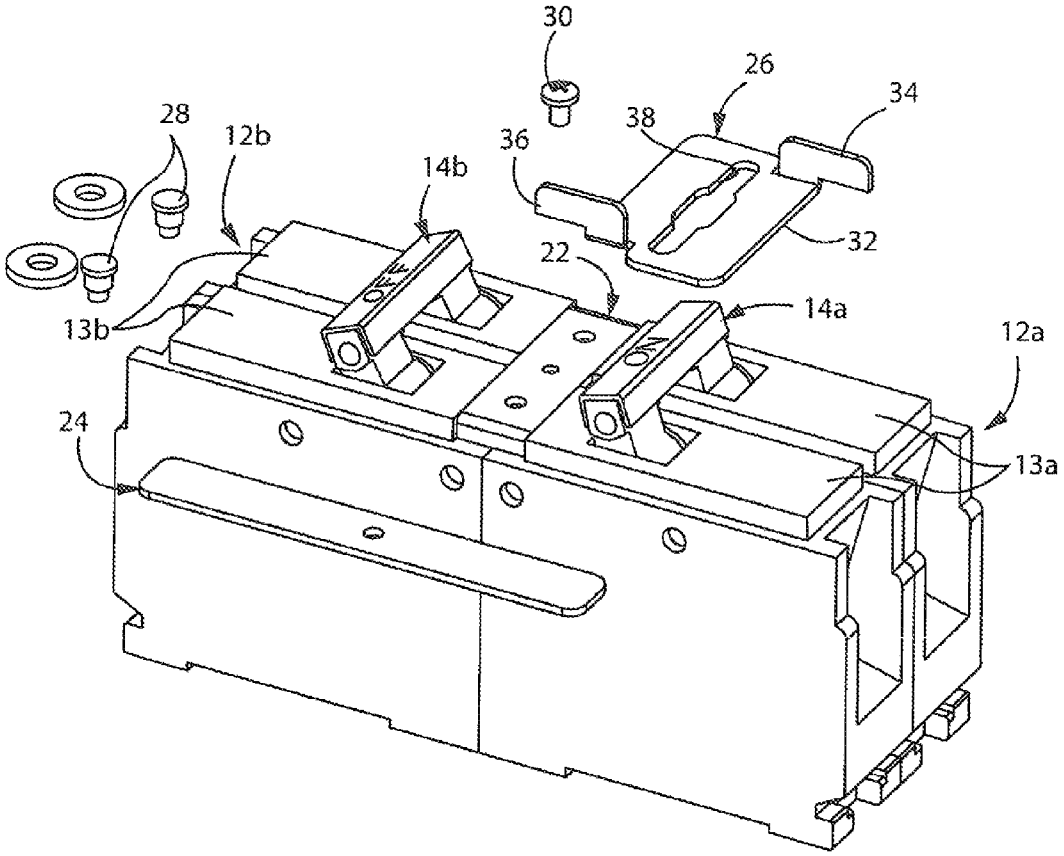
FIG. 3 is an exploded isometric view of the electrical switches of FIG. 2 showing the interlock arrangement removed from the switch handles and the switch handles uncoupled from each other.

Referring now to FIGS. 2 and 3, the switches 12*a*, 12*b* are shown as being removed from the power transfer switch 10 for illustrative purposes. In accordance with the present invention, the interlock arrangement 20 of the present invention is employed in order to ensure that switches 12*a* and 12*b* cannot be in the ON position at the same time. Generally, interlock arrangement 20 includes a base member 22, an alignment bar 24, and an interlock member 26, which, in a manner to be explained, can be selectively positioned so as to ensure that one of the switch handles 14*a*, 14*b* is in the OFF position when the other is in the ON position and vice versa.

The base 22 may take any satisfactory form, and representatively may be in the form of a rectangular block of material that is fitted between the surface bosses of the switches 12*a*, 12*b*. Again, it is understood that any other satisfactory mounting arrangement may be employed. Base 22 supports a pair of T-shaped studs 28, which, in a manner to be explained, guide movement of interlock member 26. Alignment bar 24 may be in the form of an elongated bar configured to fit within the space formed by the bridge portions of the tied together switch handles 14*a*, 14*b* and above the surface bosses 13*a*, 13*b* of switches 12*a*, 12*b*. Alignment bar 24 may be secured to base 22 using a fastener such as a screw 30 or the like.

Figure 6:
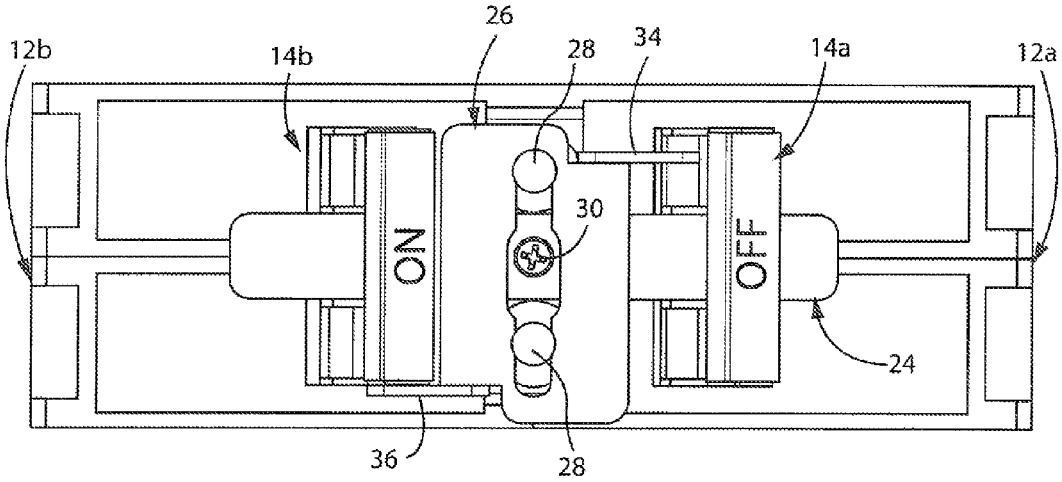

Interlock member 26 includes a generally planar body portion 32 and a pair of blocking components, which in the illustrated embodiment are in the form of an upturned blocking flange 34 at one end and an upturned blocking flange 36 at the other. Body portion 32 of interlock member 26 further includes a slot 38 that extends transversely relative to the direction of movement of switch handles 14*a*, 14*b*. Slot 38 includes a widened central area within which the head or screw 30 is received. The shanks of the T-shaped studs 28 are received within the end portions of slot 38, such that engagement of studs 28 within the end portions of slot 38 guides axial movement of interlock member 26, and engagement of the ends of slot 38 with the shanks of the T-shaped studs 28 defines the range of motion of interlock member 26. With this arrangement, interlock member 26 can be moved between a first interlock position as shown in FIGS. 2 and 4 which maintains second switch handle 14*b* in the OFF position as long as first switch handle 14*a* is in the ON position, and a second interlock position as shown in FIG. 6 which maintains first switch handle 14*a* in the OFF position as long as second switch handle 14*b* is in the ON position.

Figure 4:
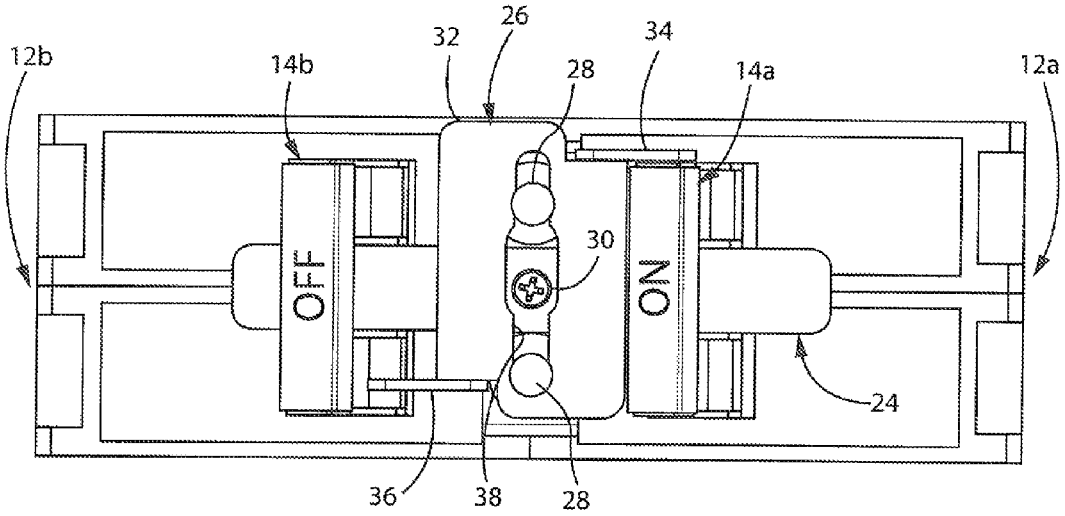
FIG. 4 is a top plan view of the electrical switches of FIG. 2 showing the interlock arrangement in a first position in which a first switch is ON and a second switch is OFF.
Figure 5:
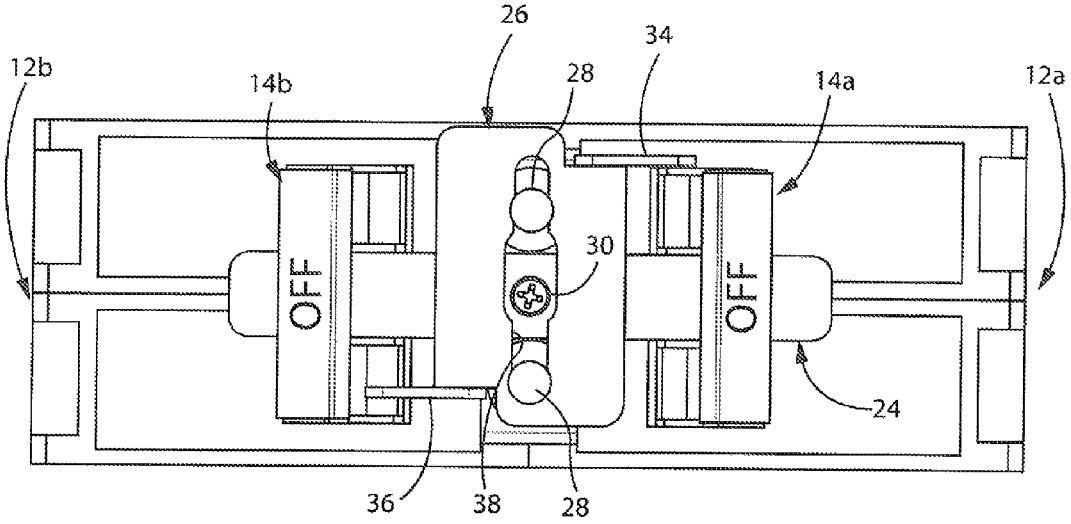
FIG. 5 is a top plan view similar to FIG. 4, showing the interlock arrangement in the first position and in which the first switch is OFF and the second switch is OFF.

With the interlock arrangement 20, switch handle 14*a* can be placed in the ON position to connect the first power supply when interlock member 26 is in the first interlock position as shown in FIGS. 2, 4 and 5. In the first interlock position, interlock member 26 is positioned such that the blocking flange 36 is in the line of movement of switch handle 14*b*, which must be in the OFF position in order for interlock member 26 to also be positioned in such a manner that allows switch handle 14*a* to move past the blocking flange 34 so that the switch handle 14*a* may be placed in the ON position. Blocking flange 36, in conjunction with blocking flange 24, thus insures that switch handle 14*b* cannot be moved away from the OFF position as long as interlock member 26 is in the first interlock position and the switch handle 14*b* is in the ON position.

Referring to FIG. 4, when interlock member 26 is in the first interlock position, flange 34 is in lateral alignment with an outer edge of switch handle 14*a* allowing the switch handle 14*b* to pass within an inner surface of flange 34 and move to an ON position. When the switch handle 14*b* is in the ON position, the interlock member 26 is prevented from movement toward the second interlock position due to interference with the end of switch handle 14*a*. Movement of interlock member 26 in the opposite direction is prevented by engagement of the end of slot 38 with the shank of the stud 28 on the flange 36 side of interlock member 26. In this manner, as long as switch handle 14*a* remains in the ON position and interlock member 26 remains in the first interlock position, switch handle 14*b* cannot be moved away from the OFF position which thus insures that the second power supply cannot be connected.

Referring to FIG. 5, when it is desired to connect the second power supply, such as when utility power normally supplied through switch 12*a* is interrupted, switch handle 14*a* is moved to the OFF position to prevent the supply of power through switch 12*a*. This moves switch handle 14*a* out of lateral alignment with flange 34, and the user is then able to move interlock member 26 from the first interlock position to the second interlock position as shown in FIG. 6, which simultaneously moves flange 34 into the line of movement of switch handle 14*a* and flange 36 out of the line of movement of switch handle 14*b*. The user can then move switch handle 14*b* to the ON position in order to connect the second power supply, while flange 34 insures that switch handle 14*a* cannot be moved away from the OFF position. When switch handle 14*b* is in the ON position, flange 36 is in lateral alignment with an outer edge switch handle 14*b* allowing the switch handle 14*b* to pass within an inner surface of flange 36 and move to an ON position, and which prevents movement of interlock member 26 away from the second interlock position to the first interlock position. This insures that flange 34 remains in the line of movement of switch handle 14*a* in order to prevent movement of switch handle 14*a* away from the OFF position.

The above-described steps are then carried out in reverse order in order to disconnect the second power supply and reconnect the first power supply.

It can thus be appreciated that the present invention provides an interlock arrangement that requires three distinct steps that must be carried out before a switch handle can be moved to its ON position in order to connect a power supply. The steps must be carried out in order, and in each case one of the steps involves first moving the switch controlling the other power supply to the OFF position. The interlock member cannot be moved to a position that allows one of the switches to be switched ON until the other switch is in the OFF position.

It should be understood that operation of the switch handles and the interlock member may be accomplished manually by a user when connecting and disconnecting power supplies, or alternatively may be accomplished using a switch operating mechanism that may be driven by one or more motors, linear actuators, cylinders, etc., or a combination thereof.

Although the best mode of carrying out the present invention is disclosed above, practice of the present invention is not limited thereto. It is further contemplated that various additions, modifications and rearrangements of the features of the present invention may be made without deviating from the spirit and scope of the invention as set forth in the following claims.

It should be understood that the invention is not limited in its application to the details of construction and arrangements of the components set forth herein. The invention is capable of other embodiments and of being practiced or carried out in various ways. Variations and modifications of the foregoing are within the scope of the present invention.

It is also understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. An interlock arrangement for a pair of aligned switches, each of which is interconnected with a supply of electrical power, comprising:

an interlock member that is positioned between the aligned switches and that is movable between a first interlock position and a second interlock position, wherein the interlock member includes a body portion, a first blocking component and a second blocking component and is movable between a first interlock position and a second interlock position, wherein the first blocking component and the second blocking component are connected to and extend from the body portion and wherein the first blocking component and the second blocking component are moveable together and with the body portion during movement of the interlock member between the first and second interlock positions;

wherein, when a first one of the switches is in an ON position in order to connect a first power supply, the interlock member is in the first interlock position in which the second blocking component is in line with a direction of movement of the second switch and prevents movement of the second switch toward its ON position and the first blocking component is positioned such that, while the first switch is in the ON position, interference between the first blocking component and the first switch prevents movement of the interlock member away from the first interlock position; and wherein, when the second switch is in its ON position in order to connect a second power supply, the interlock member is in the second interlock position in which the first blocking component is in line with a direction of movement of the first switch and prevents movement of the first switch toward its ON position and the second blocking component is positioned such that, while the second switch is in the ON position, interference between the second blocking component and the second switch prevents movement of the interlock member away from the second interlock position.

2. The interlock arrangement of claim 1 wherein the body portion of the interlock member has a slot that extends transversely relative to the directions of movement of the first and second switches.

3. The interlock arrangement of claim 2 further comprising a pair of studs received within the slot and guiding axial movement of the interlock member between the first and second interlock positions.

4. The interlock arrangement of claim 2 further comprising an alignment bar that extends transversely to the slot and is secured to the first and second switches.

5. The interlock arrangement of claim 4 wherein the slot has a widened central area within which the head of a fastener is received.

6. The interlock arrangement of claim 3 further comprising a base fitted between the first and second switches and supporting the pair of studs.

7. The interlock arrangement of claim 1 wherein in the first interlock position, the first switch is blocked by the first blocking, component such that a switch handle of the first switch contacts the first blocking component, and in the second interlock position, the second switch is blocked by the second blocking component such that a switch handle of the second switch contacts the second blocking component.

8. The interlock arrangement of claim 1 wherein the first and second blocking components are upturned flanges that are integrally formed with the body portion.

9. An interlock arrangement for switches comprising:

a first switch having a first switch member that is movable in a first switching direction between a first position and a second position;

a second switch having a second switch member that is movable in a second switching direction between a first position and a second position, wherein the first and second switching directions are in alignment with each other;

an interlock member that is positioned between the first and second switches and that is movable between a first interlock position and a second interlock position, wherein the interlock member includes a body portion, a first blocking component and a second blocking component, and wherein the interlock member is movable between a first interlock position and a second interlock position, wherein the first blocking component and the second blocking component are connected to and extend from the body portion and wherein the first blocking component and the second blocking component are moveable together and with the body portion during movement of the interlock member between the first and second interlock positions;

wherein, when the first switch is in its first position, the interlock member is in the first interlock position in which the second blocking component is in line with a direction of movement of the second switch and prevents movement of the second switch toward its first position and the first blocking component is positioned such that, while the first switch is in the first position, interference between the first blocking component and the first switch prevents movement of the interlock member away from the first interlock position; and wherein, when the second switch is in its first position, the interlock member is in the second interlock position in which the first blocking component is in line with a direction of movement of the first switch and prevents movement of the first switch to aid its first position and the second blocking component is positioned such that, while the second switch is in the first position, interference between the second blocking component and the second switch prevents movement of the interlock member away from the second interlock position.

10. The interlock arrangement of claim 9 wherein the interlock member has a slot that extends transversely relative to the directions of movement of the first and second switches.

11. The interlock arrangement of claim 10 further comprising a pair of studs received within the slot and guiding axial movement of the interlock member between the first and second interlock positions.

12. The interlock arrangement of claim 10 further comprising an alignment bar that extends transversely to the slot and extends through openings defined by the first and second switches.

13. The interlock arrangement of claim 9 wherein the first and second switches are each interconnected with a supply of electrical power and the first position of the first switch connects a first power supply, and the first position of the second switch connects a second power supply.

14. A method of operating an interlock arrangement for a pair of aligned switches, each of which is interconnected with a power supply, comprising the steps of:

positioning an interlock member between the aligned switches, wherein the interlock member is movable between a first interlock position and a second interlock position and has a body portion, a first blocking component and a second blocking component, wherein the first blocking component and the second blocking component are connected to and extend from the body portion and wherein the first blocking component and the second blocking component are moveable together and with the body portion during movement of the interlock member between the first and second interlock positions;

wherein, when a first one of the switches is in the ON position in order to connect a first power supply, the interlock member is in the first interlock position in which the second blocking component is in line with a direction of movement of the second switch and prevents movement of the second switch toward the ON position and the first blocking component is positioned such that, while the first switch is in the ON position, interference between the first blocking component and the first switch prevents movement of the interlock member away from the first interlock position;

wherein, when it is desired to switch power sources, the first switch is moved to the OFF position in order to disconnect the first power supply such that the first switch is positioned so that it does not interfere with movement of the first blocking component;

moving the interlock member from the first interlock position to the second interlock position wherein, when the interlock member is moved to the second interlock position, the first blocking component is positioned in line with a direction of movement of the first switch so as to prevent movement of the first switch hack to the ON position and the second blocking component of the interlock member is positioned so as to allow movement of the second switch from the OFF position to the ON position, and moving the second switch to the ON position, wherein interference between the second blocking component and the second switch prevents movement of the interlock member away from the second interlock position in order to maintain the first switch in the OFF position as long as the second switch is in the ON position.

15. The method of claim 14 wherein the interlock member has a slot that extends transversely relative to the directions of movement of the first and second switches.

16. The method of claim 15 further comprising a pair of studs received within the slot and guiding axial movement of the interlock member between the first and second interlock positions.

* * * * *